US006536622B1

(12) United States Patent
Planet

(10) Patent No.: US 6,536,622 B1
(45) Date of Patent: Mar. 25, 2003

(54) BOTTLES OR PACKS PROVIDED WITH POURING SPOUT WITH A CAP ON THE REMOVABLE SEAL OR TOP

(76) Inventor: Robert Planet, 28, route de Genève, F-01160 Pont d'Ain (FR)

( * ) Notice: Subject to any disclaimer, the term of this patent is extended or adjusted under 35 U.S.C. 154(b) by 0 days.

(21) Appl. No.: 09/889,151

(22) PCT Filed: Jan. 5, 2000

(86) PCT No.: PCT/FR00/00008

§ 371 (c)(1),
(2), (4) Date: Jul. 12, 2001

(87) PCT Pub. No.: WO00/41936

PCT Pub. Date: Jul. 20, 2000

(30) Foreign Application Priority Data

Jan. 15, 1999 (FR) ..... 99 00595

(51) Int. Cl.[7] ..... B65D 17/34; B65D 21/00

(52) U.S. Cl. ..... 220/269; 220/276; 220/712; 206/515

(58) Field of Search ..... 220/266, 276, 220/269, 270, 712, 713, 703; 206/515

(56) References Cited

U.S. PATENT DOCUMENTS

| | | | | |
|---|---|---|---|---|
| 2,876,692 A | | 3/1959 | Gaisman | |
| 4,898,295 A | * | 2/1990 | Kim | 220/613 |
| 4,971,218 A | * | 11/1990 | Buchner et al. | 220/271 |
| 5,125,512 A | | 6/1992 | O'Leary | |
| 5,373,961 A | | 12/1994 | Harris et al. | |
| 5,617,968 A | * | 4/1997 | Luburic | 220/276 |
| 5,636,771 A | * | 6/1997 | Gordon et al. | 222/541.5 |
| 5,865,335 A | * | 2/1999 | Farrell et al. | 220/270 |

FOREIGN PATENT DOCUMENTS

| | | |
|---|---|---|
| DE | 44 35 822 A1 | 4/1995 |
| FR | 2 646 694 A1 | 11/1990 |
| FR | 2 684 352 A1 | 6/1993 |
| GB | 2 003 446 A | 3/1979 |
| WO | WO 92/16412 A2 | 10/1992 |

* cited by examiner

*Primary Examiner*—Joseph M. Moy
(74) *Attorney, Agent, or Firm*—Oliff & Berridge, PLC

(57) ABSTRACT

The invention concern the field of storage, transport, recovery and recycling of bottles or packs (2) made of plastic or other material. It provides the possibility of using the content of bottles or packs (2) at will, using the pouring spout (6) and the cap (3) mounted on the tops (1) which are screwed on, clipped on or fixed by other means, and on the standard seals (5) in any material, fixed on the top of bottles or packs before the tops or seals are definitively removed for stacking the bottles or packs (2). The inventive design aims at facilitating the stacking of bottles or packs to reduce storage space and for transport for refill in a reduced space, and, ultimately to facilitate collection for recycling or transformation into raw material. The inventive concept uses for transport supports (10) designed to receive the bases of the bottles or packs (2), the top of the stack receiving plates with the impression of the caps (3) to protect them during transportation of the filled bottles or packs (2). The inventive concept fulfils the need to use the product contained in bottles or packs (2) at the rate desired by the consumer, and at will, since he has the possibility of closing the container with the cap (3) without having to remove the seal (5) or the top (1), and without the product being too uncovered and therefore likely to spill.

8 Claims, 2 Drawing Sheets

Figures 1, 2:
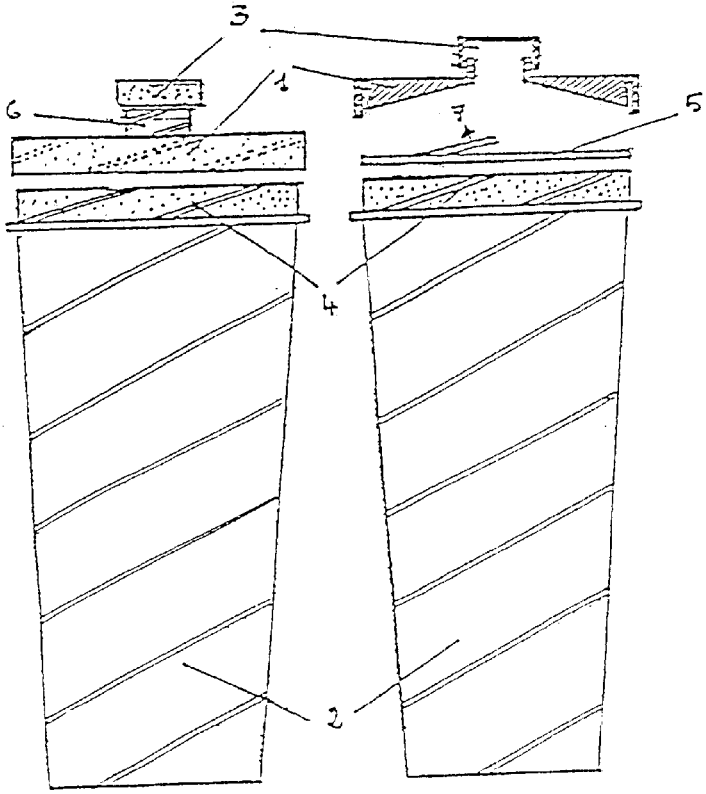

BOTTLES OR PACKS PROVIDED WITH POURING SPOUT WITH A CAP ON THE REMOVABLE SEAL OR TOP

The present invention relates to a concept enabling any bottles or packs (2) made of plastic or of any other material, of any shape, capacity, colour and consistency, to fit snugly into one another before or after use by a system which will be described, or any other system enabling this end to be achieved. Stacking after use facilitates collection for recycling purposes. Stacking before use enables bottles or packs (2) to be manufactured on one site and sent to the bottling plants at a rate of about 50,000 B/m3. The bottlers will then only have a small investment to make in a filling and sealing machine.

The originality of this invention compared with the prior art which enables containers to be stacked is that optimum use of the content of the bottle or pack (2) is achieved due to the cap (3) and the pouring spout (6) which we have placed on the conventional seal (5) or top (1).

This cap (3) and pouring spout (6), by a technique developed by the inventor, can be placed in the centre of the conventional top (1) or seal (5), eccentrically or in any other position.

It can be heat-welded, stuck, sealed or assembled by any other contact technique.

U.S. Pat. No. 5,125,512 of Jun. 30, 1992 filed by Arthur J. O'LEARY relates to glasses which can be stacked after the screw-on top has been removed. There is no ease of pouring the content unless the top part is totally removed.

In U.S. Pat. No. 5,373,961 of Dec. 20, 1994 filed by Jack HARRIS, the containers are also stacked, the top is a removable capsule provided with a hole through which a straw or a graduated instrument is inserted. Such a hole does not give satisfaction for using the content.

In our concept, the recommended shape at the outset is conical, regular or progressive, which enables the bottles or packs (2) to be nested in one another by removing the top (1) as explained further on.

In FIG. 1, a shape can be seen which can be given to the bottle or pack (2), equipped with its top (1), whereon the pouring spout (6) and cap (3) are located.

FIG. 2 represents the same bottle where a conventional seal (5) with a pull-ring (7) is added.

Figure 3:
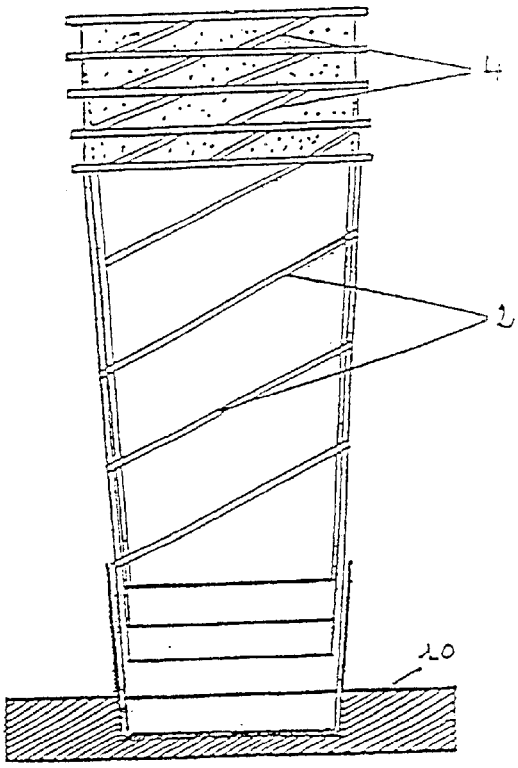

In FIG. 3, we can see the stacking system on the plank (10).

Figures 4, 5, 6:
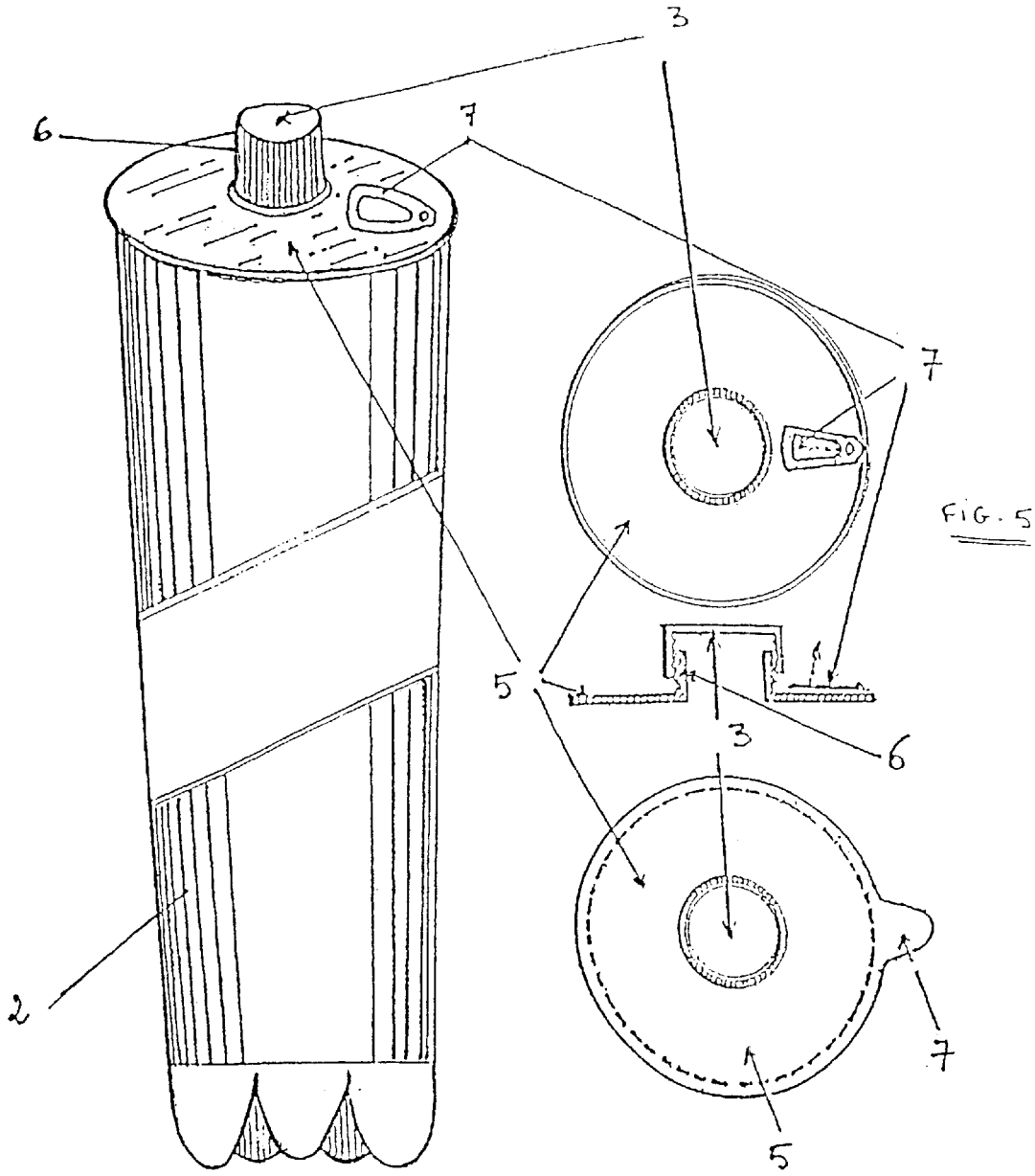

In FIG. 4, the bottle or pack (2) of different shape, equipped with a conventional seal (5), whereon a cap (3) and pouring spout (6) are fitted. FIGS. 5 and 6.

Over all or part of the height, the bottle or pack (2) can be smooth or comprise grooves or patterns which give the bottle or pack (2) its strength.

The top (1:) is fixed onto the bottle or pack (2) by any known means enabling tightness to be achieved, for example the top part of the bottle or pack (2) can be thread-cut in the same way as the cap (3) or be extracted by any known means (cutting wire or other, rip-off plastic, clipping, cover bayonet).

The top is extracted in such a way as to enable the empty bottles or packs (2) to be inserted in one another.

This system enables storage directly on the user's premises with a considerable saving of space. He can place these bottles or packs (2) on the plank (10) provided for this purpose.

Circular holes with a single or concentric thread, universal clipping system or other, are drilled in this plank (10). This plank (10) can be designed for two holes, up to pallets of 100 holes for collective bodies.

For handling and transport, a plate comprising impressions corresponding to the tops of the bottles or packs (2) is provided at the top of the stack.

For protection of the caps (3), it will be the impression of the caps.

An example of storage of 100 bottles or packs (2) will have overall dimensions of 1.30 metres in height for a diameter of 9 cm. The thickness of this cylinder will be about 3 cm. This cylinder becomes extremely strong and will be able to be used after heating for filling with any material, posts for building and public works, for running cables after holes have been drilled, for making fences, for storing products or waste, and for miscellaneous uses, thus enabling recycling without pollution or dumping.

By heating to a temperature close to the melting temperature, the volume of the plastic cylinders decreases producing a compact block without gas or ashes being dispersed.

The use of thermosetting plastic material results in a hard mass being obtained able to be used as raw material.

For collective bodies, the pallets can have a size of 1 m×1 m with the system of the plank (10), these 1 m3 pallets can receive from 8,000 to 100,000 stackable bottles or packs (2) depending on their shape and the thread-cut of their top part.

Each user can thus achieve:

space saving, time saving, savings on transport, recycling without waste emission.

NB: the bottles in their initial form represent an overall space occupation of 300 B/m3;

By manual compacting: 1,500 B/m3

With this concept: from 8,000 to 100,000 B/m3.

One feature of the invention is that the product is made up of two parts:

1) A bottle or pack (2), containing a liquid or other product, closed by a conventional seal (5), such as for example a metal can containing beverages.

2) A top (1) able to cover the top part of the bottle or pack (2) with a means enabling tightness to be achieved. The top (1) having on top of it a pouring spout (6) which can be closed by a cap (3). This assembly is then used as an ordinary bottle by opening the cap (3) and pouring.

When the bottle or pack (2) is empty, the user separates the top (1), which he can keep for use on a new bottle or pack (2).

An empty bottle or pack (2) can then, if it has been given a conical shape, be stacked in other bottles or packs (2), thus enabling easy storage of this waste product by stacking.

The alternative embodiments of this concept made to my Patent application 9,900,595:

In a first alternative embodiment, it is the bottom of the bottle or pack (2) which is removable. It can be assimilated to a top (1) which is screwed or fixed by any other means onto the bottom of the bottle or pack (2). FIG.7

When the bottle or pack (2) is empty, the user then simply has to remove the bottom to have a stackable bottle or pack (2).

The bottom of the bottle or pack (2) can also, instead of the top (1) FIG.7, have a conventional seal (5) FIG.8, made of plastic, iron or any other material which is stuck, crimped or heat-welded or fixed by any other technique, which, once removed, after the content has been used, enables a stackable bottle or pack (2) to be had.

In the second alternative embodiment, it is the top part of the bottle or pack (2) which is removed to enable stacking.

FIG.4. The top part is a conventional seal (5) for example made of crimped metal, plastic or any other material as previously mentioned. The originality of the invention is that a pouring spout (6) comprising a cap (3) is placed directly on the conventional, seal (5) or on the top (1). This cap (3) is placed in the centre or eccentric or placed in any position on the top (1) or seal (5).

The pouring spout (6) and cap (3) enable the content of the bottle or pack (2) to be used at will without removing the conventional seal (5) or the top (1). When the bottle or pack (2) is empty, the user removes the conventional seal (5) by a means known for this purpose—pull-ring (7), tab or other, thus enabling empty bottles or packs (2) to be stacked.

No priority mentions the originality of this concept which lies in the fact that a cap (3) with a pouring spout (6) has been provided on the conventional seal (5) or the top (1) in order to use the content of the bottle or pack (2) at will before definitively removing the top (1) or seal (5) for stacking purposes.

The stackable bottles or packs (2), allow any cylindrical, pyramidal, cubic, rectangular or other shapes, provided they are slightly tapered to enable stacking.

I claim:

1. A stackable bottle comprising, on the top part, an opening closed by a seal equipped with a pouring spout enabling the content of the bottle to be poured without detaching the seal, the seal being able to be detached to enable empty bottles to be stacked, a bottle wherein the seal is equipped with a pull-ring enabling the seal to be torn off from the bottle.

2. A bottle according to claim 1, wherein the seal is a flat seal.

3. A bottle according to claim 1, wherein the pull-ring is arranged on an upper face of the seal.

4. A bottle according to claim 1, wherein the pull-ring is salient at the periphery of the seal.

5. A bottle according to claim 1, comprising a cap for closing the pouring spout.

6. A bottle according to claim 1, wherein the pouring spout is placed in the centre of the seal.

7. A bottle according to claim 1, wherein the pouring spout is eccentric with respect to the centre of the seal.

8. A bottle according to claim 1, wherein the pouring spout can be sealed, heat-welded, stuck, assembled by any contact technique, moulded or formed as a single element forming a top—cap block, the seal being a conventional seal made of metal, aluminium, plastic, paper or any other material, the bottle presenting any shape, any size, and any material.

* * * * *